United States Patent [19]

Kin

[11] 3,934,635

[45] Jan. 27, 1976

[54] OVERHEAD DOOR FOR A CONTAINER HAVING A VERTICAL OPENING SUCH AS A TRUCK TRAILER

[75] Inventor: Henry Kin, Forest Park, Ohio

[73] Assignee: KRS Industries, Inc., Forest Park, Ohio

[22] Filed: Oct. 17, 1972

[21] Appl. No.: 298,331

[52] U.S. Cl. ..... 160/189; 49/358; 160/190

[51] Int. Cl.[2] ..... E05F 11/00

[58] Field of Search ..... 160/188, 189, 190, 191; 49/358, 360, 199, 200; 292/39

[56] References Cited

UNITED STATES PATENTS

| | | | |
|---|---|---|---|
| 2,015,402 | 9/1935 | Johanson | 160/189 |
| 2,703,236 | 3/1955 | Verdier | 49/358 |
| 2,978,021 | 4/1961 | Stroup et al. | 160/191 |
| 3,110,512 | 11/1963 | Scalf et al. | 292/39 |
| 3,311,159 | 3/1967 | Stansberry | 160/189 |
| 3,436,862 | 4/1969 | Stansberry | 49/358 |

*Primary Examiner*—Paul R. Gilliam
*Assistant Examiner*—Carl F. Pietruszka
*Attorney, Agent, or Firm*—John G. Schenk

[57] ABSTRACT

An overhead door for the vertical opening of a truck trailer comprises a plurality of panels connected together by hinges, which extend the width of the panels and are confined within the panel. The panels, which are preferably formed of plastic, are counterbalanced by a spring, which is movable with the panels. The spring is wound by gears, which are connected thereto, cooperating with racks on the horizontal portions of the tracks on which the panels are movably supported. The bottom panel is locked to the trailer body by a locking mechanism, which is carried by the lowermost panel and cooperates with locking pins on the mounting angles on which the vertical portions of the tracks are supported.

6 Claims, 11 Drawing Figures

OVERHEAD DOOR FOR A CONTAINER HAVING A VERTICAL OPENING SUCH AS A TRUCK TRAILER

When a truck trailer has an overhead door to close its vertical opening, the trailer can be backed directly to a loading dock and the door lifted after the truck has been backed to the dock. When a truck trailer has swing type doors, it is necessary for the driver to stop the vehicle before the dock is reached, open each swing door and secure it to the side of the trailer, return to the vehicle, and back the trailer to the loading dock. Thus, the overhead door significantly reduces the time required to position a truck trailer at a loading dock.

While the overhead door has the foregoing advantage over swing doors, the previously available overhead doors have had disadvantages that have reduced their use in place of swing doors notwithstanding their advantages. One disadvantage has been the heavier weight of the overhead door compared with the swing doors. This increased weight increases the cost of operation of the truck trailer.

The overhead door of the present invention satisfactorily overcomes the foregoing problem by weighing significantly less than the previously available overhead doors, which have been formed of plywood or plywood with an aluminum skin. The overhead door of the present invention is formed of panels made of a strong, hard, rigid thermoplastic which will not easily chip, peel, warp, or break. One suitable example of the material of the panel of the present invention is ABS type thermoplastic.

In the previously available overhead doors, the panels have been connected to each other by a hinge system in which the hinges are exposed. With the previously available overhead doors, holes had to be drilled symmetrically for the hinge attachment to obtain the correct load distribution.

Furthermore, the protruding hinges of the previously available overhead doors often snag any shifting cargo within the trailer. If this occurs, the door has had to be disassembled in order for the door to be opened.

The overhead door of the present invention satisfactorily overcomes the foregoing problems by concealing the hinge structure within the panels. Accordingly, the interior surface of the overhead door is flush and cannot snag a shifting cargo.

Additionally, the door of the present invention is formed with the hinges extending the full width of each of the panels. As a result, the load is distributed over the full length of the panel rather than only at the hinges as occurs with the previously available panels formed of plywood or plywood with an aluminum skin.

By forming the hinges within the panel and along the entire width, the time for assembly of the overhead door of the present invention is reduced in comparison with the time to assemble the previously available overhead doors. This is because there is no requirement for lining up holes, drilling the holes, and attaching hinges as in the previously available overhead doors. The hinge construction of the overhead door of the present invention reduces not only the time for assembly but also the skill of the assembler since there is no requirement for lining up holes and drilling the holes.

The width of the opening of the truck trailer varies not only between manufacturers but also between trailers of the same manufacturer. This has presented significant problems for overhead door manufacturers in standardizing on widths. It also has required a significant inventory of various size overhead doors.

The present invention overcomes the foregoing problems by eliminating any requirement for panels of specific widths. This is because the panel of the present invention can be cut to any width and installed since the hinges extend the full width of the panel and can be readily cut at the same time as the panel is cut.

In the previously available overhead doors, a cable and drum type arrangement has been employed for counterbalancing the door with the cable being connected to the bottom panel and the drum disposed in the upper portion of the trailer. This arrangement has required the upper panel of the door to travel around a radius until it is vertical. As a result of both the space needed for mounting the drum and the turning radius for the upper panel of the door, the previously available overhead doors have required approximately 7½ inches at the top of the truck trailer for the track and the overhead door structure. By using a linkage arrangement to connect the top panel of the door of the present invention to the counterbalance means, only approximately 3½ inches is required. Thus, in a trailer having a 40 foot length this 4 inch saving results in an over-all more efficient utilization of approximately 100 cubic feet.

The previously available overhead doors have employed both a single cable and two cables to connect the bottom panel of the door to the drum. When the single cable is used, the breaking of the cable results in the door falling, if it is open, or being extremely difficult to open if it is closed. If the door is open and the cable breaks, the falling of the door could cause an injury.

With a two cable arrangement, installation is difficult. If the tensions on the two cables are not equal, a jamming or cocking action of the door results.

Since broken cables are a continual problem in the field and require a skilled mechanic to reset a new cable, the counterbalance arrangement of the cable and drum of the previously available overhead doors has greatly increased costs over swing type doors, for example.

The overhead door of the present invention satisfactorily solves the foregoing problem through using a spring, which is carried with the door, for producing the counterbalance force. The counterbalance by the spring is achieved through gears connected to the spring and cooperating with racks fixed to the horizontal portions of the tracks on which the panels are movably supported. As a result, there is a total elimination of cables and their costly and difficult replacement. Additionally, safety in using the door is increased. There is also no problem in installation as in the previously available doors using the cable and drum arrangement.

With the previously available overhead doors, the door had been locked at its bottom through forming an opening in the floor of the truck trailer. This has not only resulted in a non-smooth floor at the entrance to the truck trailer but also has caused an extra operation during installation. This extra operation, which is due to a lock catch for a locking pin, results in a higher installation cost.

The overhead door of the present invention satisfactorily solves the foregoing problem by using a locking arrangement in which the fixed lock portion is mounted on the track mounting supports rather than in the floor of the truck trailer. As a result, the installation operation of forming an opening in the floor for a lock catch is eliminated.

The locking arrangement of the overhead door of the present invention also enables the lock to be adjusted for the width of the panel without any necessity for cutting any parts of the locking arrangement. Thus, a single lock is readily usable with doors of various widths.

An object of this invention is to provide a relatively lightweight overhead door for a container such as a truck trailer, for example.

Another object of this invention is to provide an overhead door that is easily adaptable to openings of various widths.

A further object of this invention is to provide an overhead door having a unique counterbalance arrangement.

Still another object of this invention is to provide an overhead door having panels in which the hinges connecting the panels are hidden.

A still further object of this invention is to provide an overhead door permitting a greater height of the door opening to allow greater utilization of the space within a container such as a truck trailer, for example.

Further objects, uses, and advantages of this invention are apparent upon a reading of this description, which proceeds with reference to the drawings forming part thereof and wherein.

Figure 1:
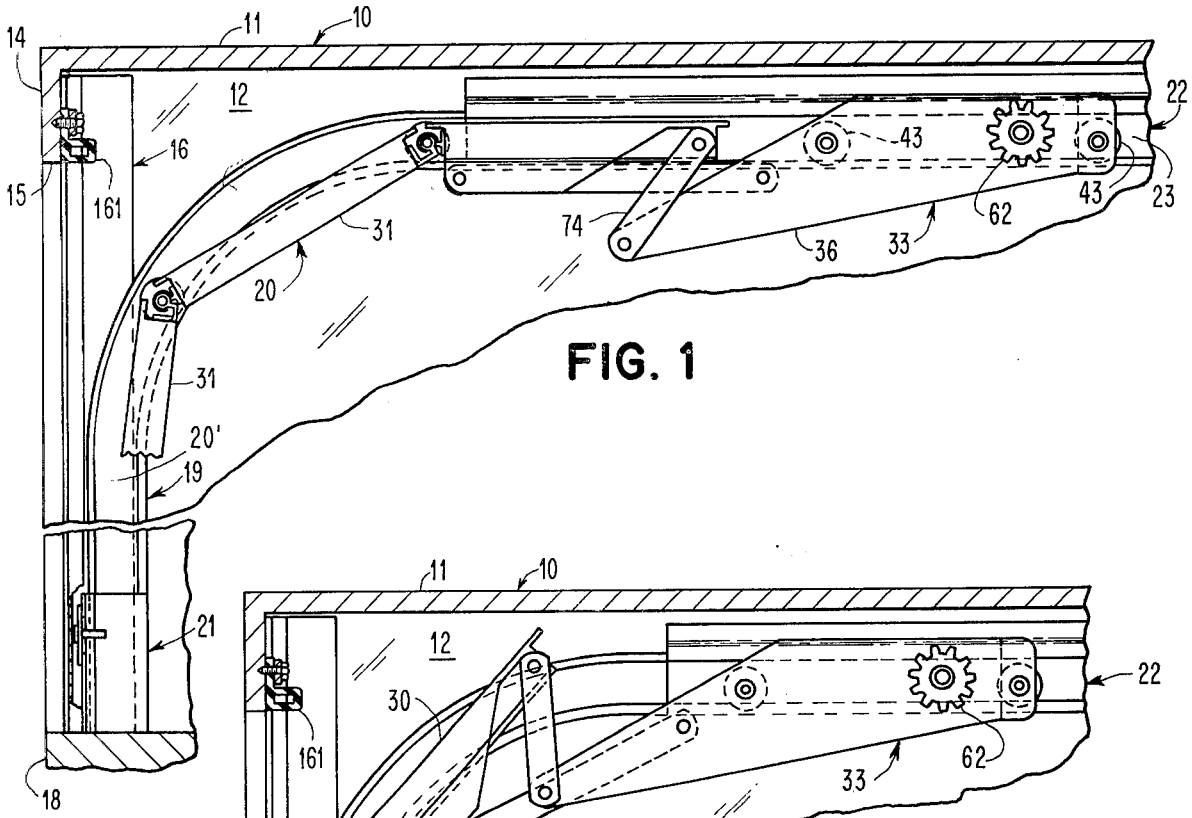
FIG. 1 is a side elevational view, partly schematic, of a portion of a tractor trailer showing the left hand track and its support arrangement and a portion of the overhead door of the present invention with the door in a partially raised position and taken substantially along line 1—1 of FIG. 5 with the rollers which ride in the right hand track removed.
Figure 2:
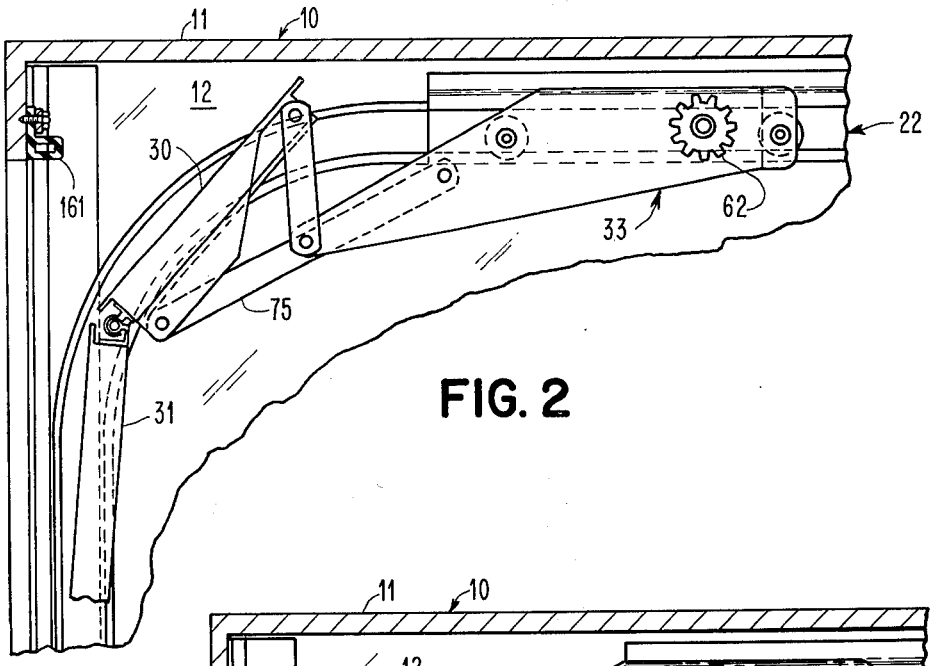
FIG. 2 is a fragmentary side elevational view, similar to FIG. 1, but showing the overhead door moving towards its closed position from FIG. 1.
Figure 10:
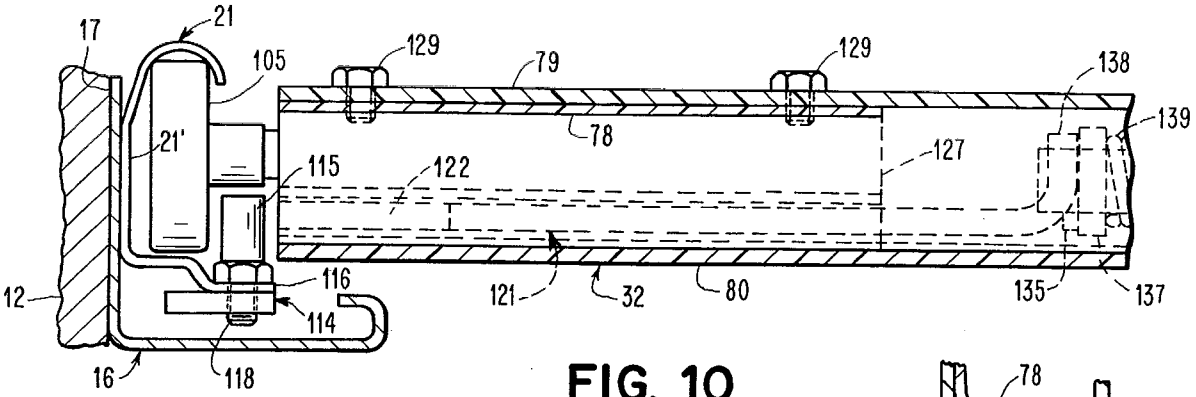
FIG. 10 is a fragmentary sectional view of the bottom panel and its track support and taken along line 10—10 of FIG. 7.

Referring to the drawings and particularly FIG. 1, there is shown a portion of a truck trailer 10. The truck trailer 10 includes a top wall 11, a side wall 12, and a rear wall 14 with an opening 15 therein. A vertical mounting angle 16 is secured to the side wall 12. As shown in FIG. 10, the vertical mounting angle 16 is L-shaped with a channel at one end and has one leg 17 fastened by suitable means such as welding, for example, to the side wall 12 of the truck trailer 10. The mounting angle 16 extends upwardly from floor 18 (see FIG. 1) of the truck trailer 10.

A track 19 is secured to the mounting angle 16 so that the track 19 forms part of the vertical portion of one side of the track means for an overhead door 20 of the present invention. The track 19 has a portion 20' welded, for example, to the leg 17 of the mounting angle 16.

The track 19 terminates above the floor 18 and a track 21 (see FIGS. 1 and 10), which functions as a mount, extends to the floor 18 of the truck trailer 10 to form the bottom part of the vertical portion of the track means for the door 20. The track 21 has a portion 21' (see FIG. 10), which is welded to the leg 17 of the vertical mounting angle 16.

As shown in FIG. 1, the track 19 includes not only a substantially vertical portion but also a curved portion at its upper end. The upper end of the curved portion of the track 19 is aligned with a track 22, which forms the horizontal portion of the track means for one side of the door 20. The track 22 has a portion 23 (see FIG. 6) welded to the side wall 12 of the truck trailer 10. The track 22 is aligned with the curved end of the track 19 so that a continuous track is formed to support one side of the overhead door 20.

The truck trailer 10 has a similar track and support arrangement supported by its other side wall. Thus, a vertical mounting angle, which is like the vertical mounting angle 16, has a leg welded to the other side wall of the truck trailer 10.

A track, which is the right hand track whereas the track 19 is the left hand track, forms part of the vertical portion of the track means for the right side of the door 20 with a track, which is like the track 21 except that it is the right hand track, forming the bottom part of the vertical track portion of the track means for the right side of the door 20. The right hand track includes both a vertical portion and a curved portion at the upper end of the vertical portion. A track, which forms the horizontal portion of the right hand track and is like the track 22, is secured to the other side wall in the same manner as the track 22 is secured to the side wall 12 and is aligned with the curved portion of the right hand track.

Figure 7:
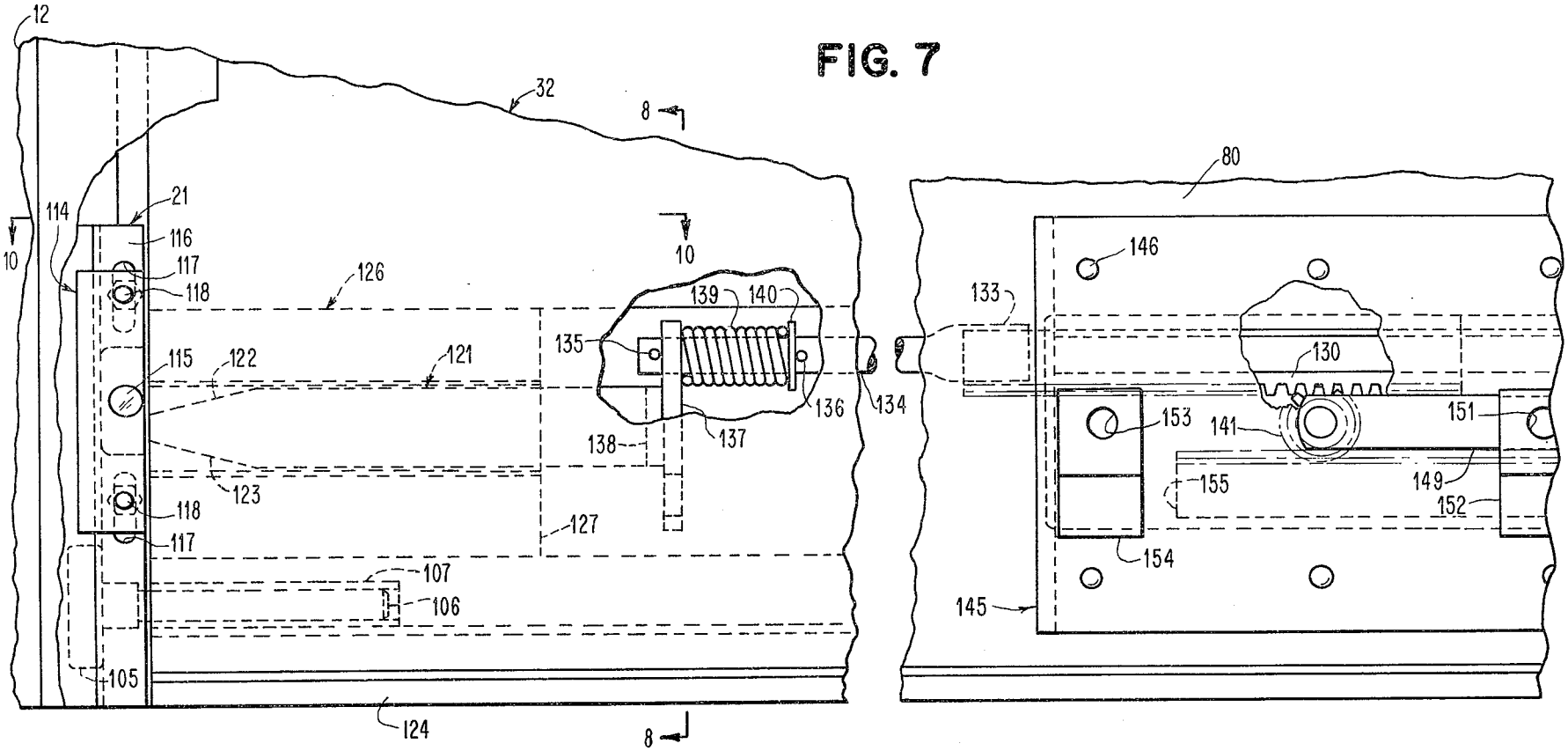
FIG. 7 is a front elevational view of the lower portion of the bottom panel of the overhead door and a portion of the track.

The overhead door 20 includes an upper panel 30, a plurality of intermediate panels 31, and a bottom panel 32 (see FIG. 7). The panels 30, 31, and 32 have their ends hingedly connected to each other.

Figure 3:
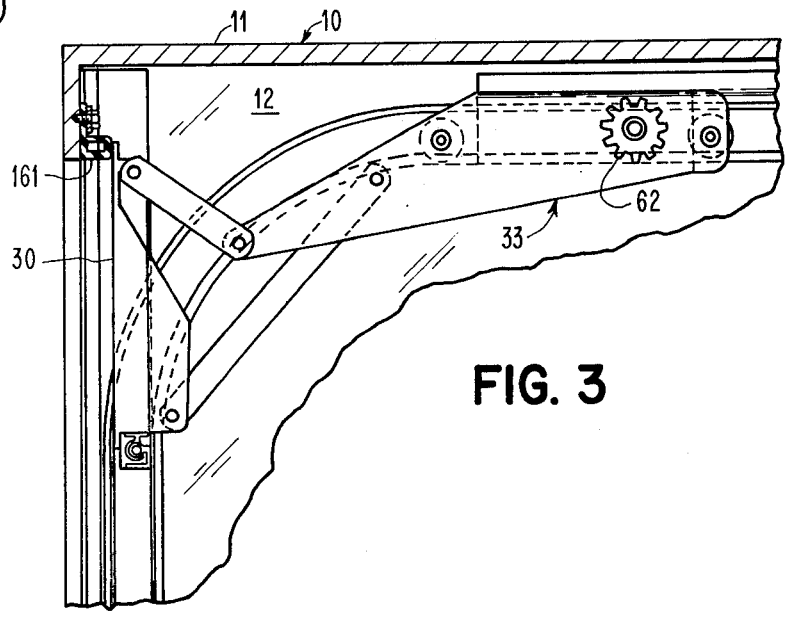
FIG. 3 is a fragmentary side elevational view, similar to FIG. 2, but showing the overhead door in its closed position.

The upper panel 30 of the overhead door is connected by a linkage mechanism to a counterbalance carriage 33, which is always supported on the horizontal portion of the track means irrespective of the position of the overhead door 20. Thus, as shown in FIG. 3, the carriage 33 still is supported by the track 22, which is the left hand horizontal portion of the track means, when the door 20 is in its closed position.

The counterbalance carriage 33 includes a pair of metallic side plates 35 and 36 (see FIG. 5), which are connected together by an L-shaped cross brace 37.

Each of the side plates 35 and 36 has an L-shaped bracket 38 welded thereto and secured to the metallic cross brace 37 by bolts 39 and nuts 40.

Each of the L-shaped brackets 38 has elongated slots 41 in each of its legs to enable adjustment of the side plates 35 and 36 relative to the cross brace 37. This adjusts the width of the carriage 33 for the width of the vertical opening 15 of the truck trailer 10.

Each of the side plates 35 and 36 has an axle mount 42' welded thereto to rotatably support a roller 43 through having its axis 42 disposed in an axle mount 42'. Each of the rollers 43 rides in one of the horizontal portions of the track means.

Each of the side plates 35 and 36 has a plate 44 adjustably connected to its forward end. Each of the plates 44 is adjustably secured to the cooperating side plate 35 or 36 by bolts 45 and nuts 46. The bolts 45 extend through elongated slots 47 (see FIG. 4) in the plate 44 and circular openings in the side plates 35 and 36.

This adjustment is made to enable a roller 49, which is mounted on an axle 50 disposed in an axle mount 50' welded to the plate 44, to be disposed in the horizontal portions of the track means. The roller 49 on the plate 44 connected to the side plate 35 is disposed in the left hand track 22 and the roller 49 on the plate 44 connected to the side plate 36 is disposed in the right hand track, which is like the track 22.

The side plate 36 has a spring shaft 51 (see FIG. 5) rotatably supported thereby, and the side plate 35 has a spring shaft extension 52 rotatably supported thereby. The shaft extension 52 is rotatably supported in the side plate 35 by a bearing 53, and the spring shaft 51 is rotatably supported in the side plate 36 by a bearing 54.

Figure 11:
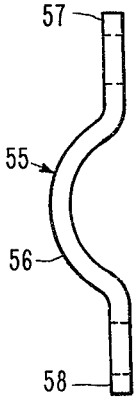
FIG. 11 is an end elevational view of an adjustment bracket.
Figure 5:
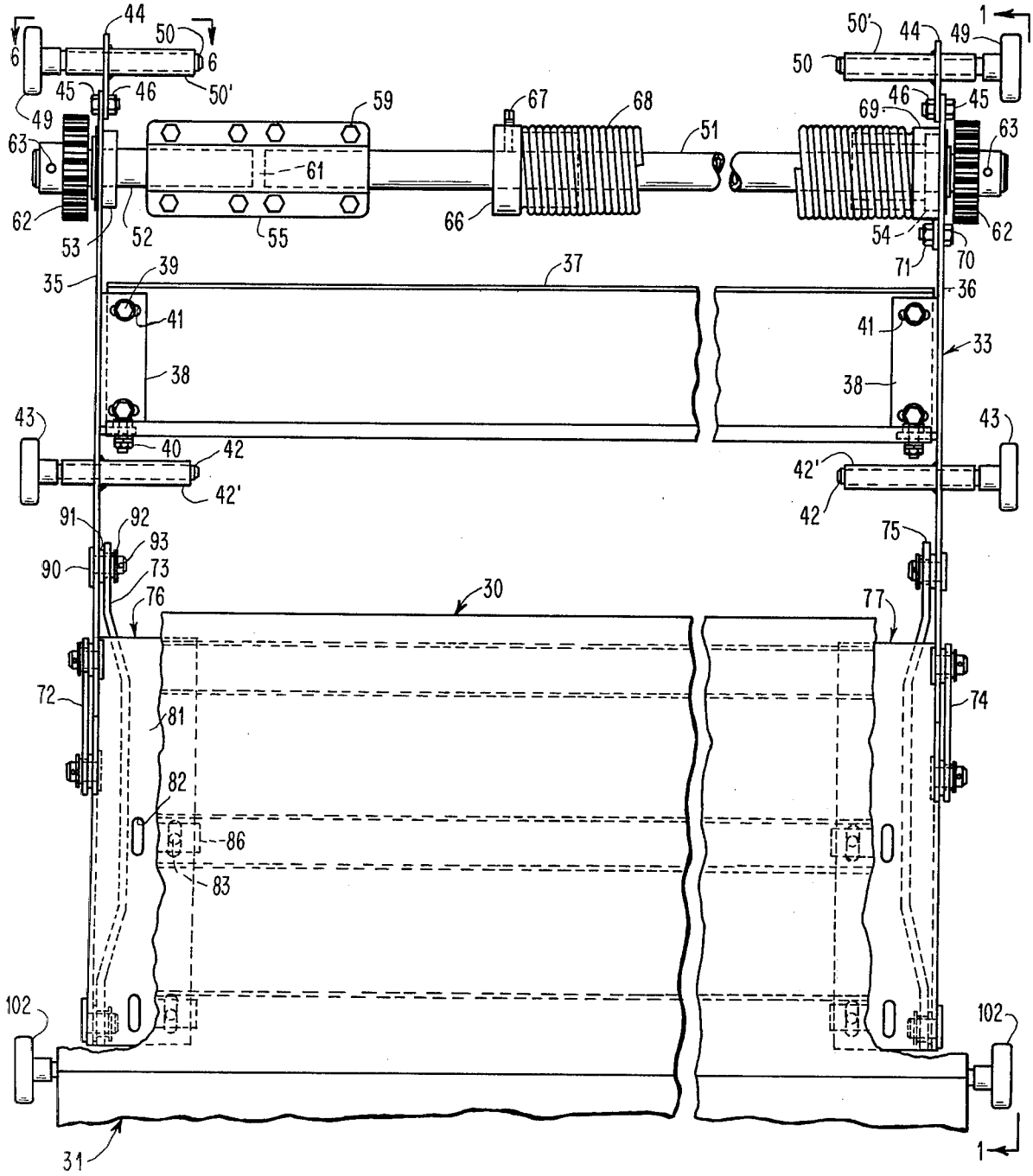
FIG. 5 is a top plan view of the upper panel of the overhead door and the counterbalance carriage without the track means being shown.

The shaft 51 and the shaft extension 52 are secured to each other by a pair of adjustment brackets 55. As shown in FIG. 11, the bracket 55 includes an arcuate center portion 56 and straight end portions 57 and 58. The arcuate portions 56 of the pair of brackets 55 fit around the shaft 51 and the shaft extension 52 with the end portions 57 and 58 having bolts 59 and nuts (not shown) to clamp them together. As a result, the shaft 51 and the shaft extension 52 are secured to each other by the brackets 55 so that they will rotate together. This also allows adjustment of the width of the carriage 33. As shown in FIG. 5, a space 61 may exist between the ends of the shaft 51 and the shaft extension 52 when they are secured to each other by the bracket 55 depending on the width of the carriage 33.

Each of the shaft 51 and the shaft extension 52 has a spur gear 62 mounted thereon and secured thereto by a pin 63, which passes through diametrically disposed portions of the hub of the gear 62 and the shaft 51 or the shaft extension 52. Each of the spur gears 62 has its teeth meshing with the teeth of an elongated track 64. One of the racks 64 is supported on each of the left hand track 22 and the right hand track (not shown).

Figure 6:
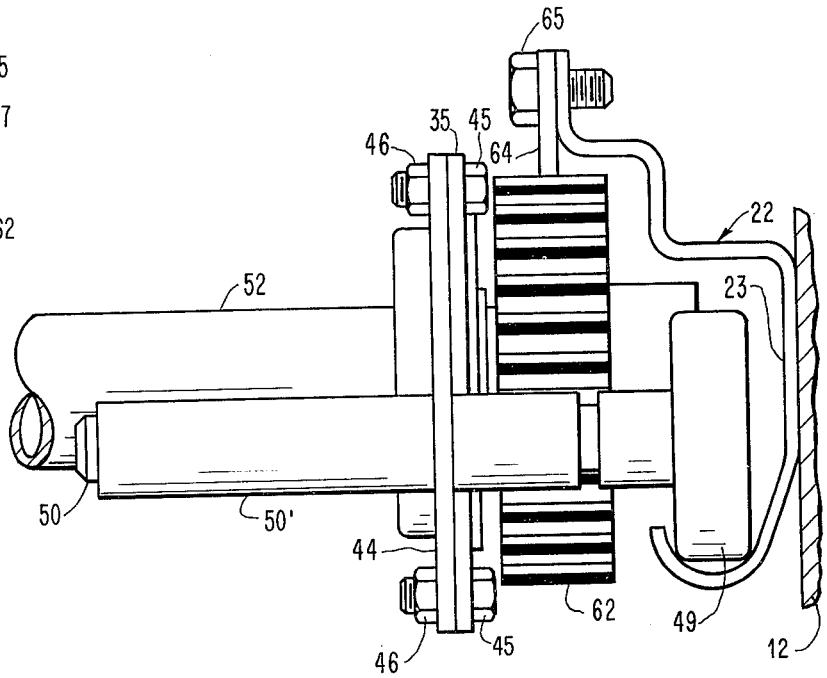
FIG. 6 is an end elevational view, partly in section, of a portion of the counterbalance carriage of FIG. 5 and taken along line 6—6 of FIG. 5 with the track means also being shown.

As shown in FIG. 6, the rack 64 is secured to the track 22 by self-tapping screws 65. The rack 64 has elongated slots therein to position the rack 64 on the track 22, which has only circular openings to receive the self-tapping screws 65. The rack 64, which is secured to the right hand track, is attached in the same manner.

The shaft 51 has a spring winding cone 66 (see FIG. 5) secured thereto by a set screw 67. One end of a torsion spring 68 is fixed to the spring winding cone 66. The other end of the spring 68 is fixed to a spring dead end cone 69, which is attached to the side plate 36 by two bolts 70 and two nuts 71.

Accordingly, when the shaft 51 and the shaft extension 52 are rotated in one direction due to the spur gears 62 cooperating with the racks 64, the spring 68 is wound tighter to increase the counterbalance force on the door 20. This occurs when the overhead door 20 is lowered from its open position towards its fully closed position. When the door moves towards its open position, the spur gears 62 are rotated in the opposite direction whereby the spring 68 is unwound to reduce the force exerted on the door 20 through the carriage 33. Accordingly, the counterbalance force is increased as the door 20 is lowered and decreased as the door 20 is raised.

The carriage 33 is connected to the upper panel 30 of the door 20 by links 72 and 73 extending between the side plate 35 and the top panel 20 and links 74 and 75 extending between the side plate 36 and the upper panel 30 of the door 20. The links 72 and 74 have the same configuration and the links 73 and 75 have the same configuration. The links 72 and 74 are disposed on the outside of the side plates 35 and 36, respectively, while the links 73 and 75 are disposed on the interior of the side plates 35 and 36, respectively.

The link 72 extends from the end of the side plate 35 to the uppermost portion of a mounting bracket 76 (see FIGS. 4 and 5), which is secured to one side of the upper panel 30. The link 73 extends from an intermediate portion of the side plate 35 to the lowermost portion of the mounting bracket 76.

The other side of the upper panel 30 has a mounting bracket 77 (see FIG. 5) thereon. The link 74 extends from the end of the side plate 36 to the uppermost portion of the mounting bracket 77 while the link 75 extends from an intermediate portion of the side plate 36 to the lowermost portion of the mounting bracket 77.

Each of the panels 30, 31, and 32 includes a core 78 (see FIG. 4) and skins 79 and 80 on opposite sides of the core 78 and bonded thereto. The core 78 and the skins 79 and 80 are formed of a suitable plastic such as ABS.

Figure 4:
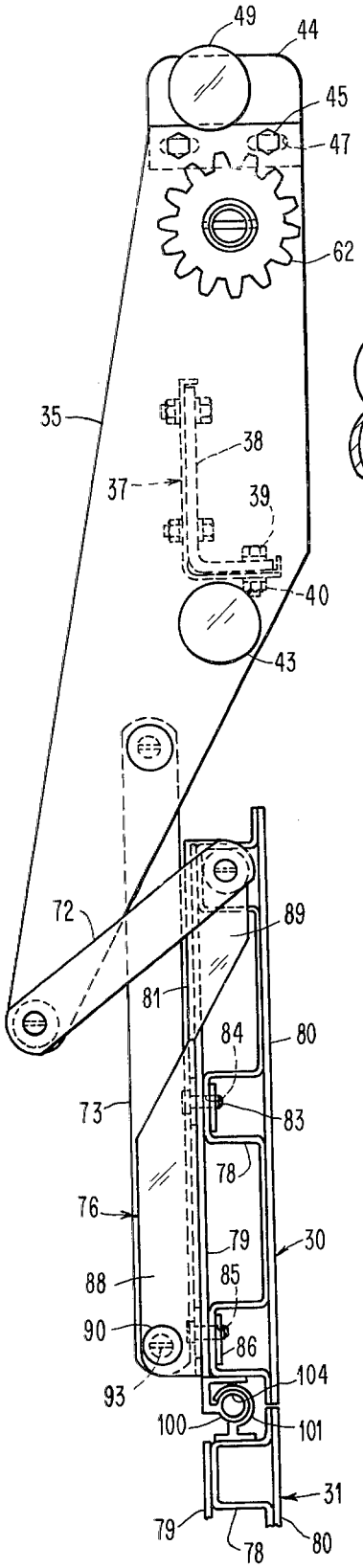
FIG. 4 is a side elevational view of the upper panel of the overhead door and the counterbalance carriage to which it is connected with a roller at the junction of the upper panel and the adjacent intermediate panel removed.

The mounting bracket 76 has a flat surface 81, which abuts the outer surface of the skin 79 of the upper panel 30 and overlies the skin 79. The flat surface 81 has four elongated slots 82 (see FIG. 5) therein to receive self-tapping screws 83. Each of the self-tapping screws 83 passes through an opening 84 (see FIG. 4) in the core 78 of the upper panel 30 and into an opening 85 in a mounting plate 86 (Each of the mounting plates 86 cooperates with two of the self-tapping screws 83.) The self-tapping screws 83 hold the mounting bracket 76 against the skin 79 of the upper panel 30 and the mounting plate 86 against a part of the core 78 of the upper panel 30 as shown in FIG. 4.

The mounting bracket 76 has a flange 88 extending from one side of the flat surface 81 away from the upper panel 30 and to which the link 73 is pivotally connected. The mounting bracket 76 has a flange 89 extending from the same side of the flat surface 81 as the flange 88 but toward the upper panel 30 and to which the link 72 is pivotally connected.

The pivotal connection of each of the links 72 and 73 to the side plate 35 and to the mounting bracket 76 is the same. Each pivotal connection includes a mounting pin 90 (see FIG. 5) passing through an opening in the side plate 35 or the mounting bracket 76 and a bearing 91, which is disposed between the side plate 35 or the mounting bracket 76 and the cooperating link 72 or 73, a washer 92, and a pin 93 extending through an opening in the mounting pin 90. Accordingly, the link 72 is pivotally connected to the side plate 35 and to the upper panel 30 through the mounting bracket 76. Similarly, the link 73 is pivotally connected to the side plate 35 and to the upper panel 30 through the mounting bracket 76.

A similar pivotal arrangement exists between the mounting bracket 77, the side plate 36, and the links 74 and 75. Thus, the upper panel 30 can pivot relative to the side plates 35 and 36 of the carriage 33 at the same time.

The lowermost portion of the upper panel 30 has a male knuckle 100, (see FIG. 4), which is formed of the same material as the core 78 and the skins 79 and 80 of the panel 30, extending for the width of the panel 30 and bonded to the core 78. The male knuckle 100 cooperates with a female knuckle 101 on the upper end of the uppermost of the intermediate panels 31. The female knuckle 101, which is formed of the same material as the core 78, extends for the width of the panel 31. The male knuckle 100 and the female knuckle 101 cooperate to form a hinge between the upper panel 30 and the uppermost of the intermediate panels 31 with the hinge extending for the width of the door 20.

Each of the intermediate panels 31 has one of the female knuckles 101 at the uppermost portion thereof and one of the male knuckles 100 at the lowermost portion thereof to form a hinge connection with the adjacent panels. Since the upper panel 30 is not connected at its upper end to a panel but is connected by the linkage arrangement to the carriage 33, the upper panel 30 does not have one of the female knuckles 101 at its upper end.

Figure 8:
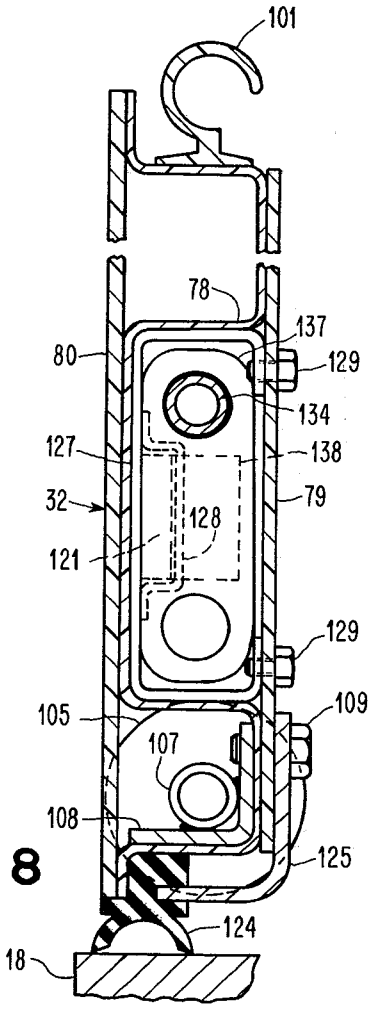
FIG. 8 is a sectional view of the bottom panel of the door and taken along line 8—8 of FIG. 7.

The bottom panel 32 (see FIG. 8) has the female knuckle 101 at its upper end. However, the bottom panel 32 is not connected at its lower end to a panel so it does not have one of the male knuckles 100 on its lower end as do all of the intermediate panels 31 and the upper panel 30.

Accordingly, the male knuckle 100 and the female knuckle 101 of adjacent panels form the hinge means between each of the panels. As previously mentioned, the knuckles 100 and 101 extend for the width of the panels and are formed of the same material so that any cutting of the panel to reduce its width for a particular width of the opening 15 of the truck trailer 10 also cuts the knuckles 100 and 101.

Furthermore, the knuckles 100 and 101 are disposed within the confines of the panel since the female knuckle 101 is completely within the skins 79 and 80 and the male knuckle 100 has its outermost surface in the same plane as the outer surface of the skin 79 of the panel. Therefore, the hinges are within the confines of the panels and cannot have a shifting load snagged thereon, for example.

Each of the hinges, which is formed by the knuckles 100 and 101 on adjacent panels, has a roller 102 (see FIG. 5) supported at each end thereof. The roller 102 has an axle extending into an opening 104 (see FIG. 4) of the male knuckle 100. Each of the rollers 102 rides in the track means.

The upper panel 30 does not have one of the rollers 102 at its upper end since it does not have a hinge connection at its upper end but is connected to the carriage 33 by the links 72, 73, 74, and 75. Thus, the upper panel 30 has the rollers 102 only at its lower end as shown in FIG. 5.

The bottom panel 32 has rollers 105 (see FIG. 7) adjacent its bottom end. Each of the rollers 105 has its axle 106 supported in a tubular housing 107. The housing 107 is welded to an L-shaped bracket 108 (see FIG. 8), which is connected to the skin 79 of the bottom panel 32 by self-tapping screws 109.

As shown in FIGS. 7 and 10, one of the rollers 105 rides in the left hand track 21 when the door 20 is in its lowermost position. The other of the rollers 105 on the bottom panel 32 rides in the right hand track when the door 20 is in its lowermost position.

A plate 114, which has a locking pin 115 welded thereto, is connected to a portion 116 of the track 21. The plate 114 is vertically adjusted on the portion 116 of the track 21 to allow the pin 115 to be disposed at a desired vertical position. The portion 116 of the track 21 has elongated vertical slots 117 to receive self-tapping screws 118, which extend through the elongated slots 117 in the portion 116 and into circular openings in the plate 114.

A plunger 121, which is movably mounted in the bottom panel 32 of the door 20, cooperates with the locking pin 115 to lock the left side of the bottom panel 32 to the truck trailer 10. A similar arrangement exists for the right side of the bottom panel 32 of the overhead door 20.

The plunger 121 has an upper tapered surface 122 (see FIG. 7) and a lower tapered surface 123. The upper tapered surface 122 slides under the bottom surface of the pin 115 to urge a seal 124 (see FIG. 8), which is preferably formed of rubber, on the lower end of the bottom panel 32 into engagement with the floor 18 of the truck trailer 10. The seal 124 extends beyond the lower end of the skin 80 of the bottom panel 32 and is supported between a portion of the skin 80 and an L-shaped bracket 125, which is mounted on the skin 79 of the bottom panel 32 by the self-tapping screws 109 that also secure the L-shaped bracket 108 to the skin 79.

The plunger 121 is movably supported in a housing 126 between the skins 79 and 80 of the bottom panel 32. The housing 126 includes a C-shaped member 127 (see FIG. 8), which is supported by the core 78 and the skins 79 and 80 of the bottom panel 32, and a U-shaped bracket 128. The member 127 is secured to the skin 79 by self-tapping screws 129 (see FIG. 10). The bracket 128 is welded to the member 127.

Figure 9:
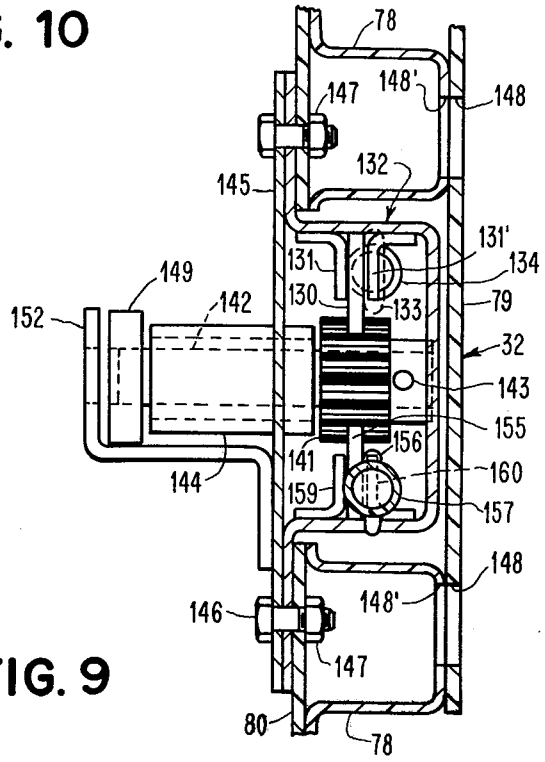
FIG. 9 is a sectional view of a portion of the bottom panel of the overhead door showing a portion of its locking mechanism and taken to the right of FIG. 7.

The plunger 121 is moved into locking engagement with the pin 115 and removed therefrom by a rack 130, which is movably mounted between guides 131 and 131' (see FIG. 9). The guides 131 and 131' are welded to a mounting plate 132, which is supported by the bottom panel 32.

The rack 130 is welded to a flat portion 133 of a push rod 134. The rod 134 has a pair of pins 135 and 136 (see FIG. 7) extending therefrom. A plate 137, which has a finger 138 of the plunger 121 welded thereto, fits over the rod 134 and is disposed between the pins 135 and 136 and adjacent the pin 135. A spring 139 surrounds the push rod 134 between the plate 137 and a washer 140, which abuts the pin 136. Accordingly, the rack 130 has a resilient connection to the plunger 121.

This resilient connection provides compensation for different amounts of movement of the plunger 121 depending on the condition of the seal 124. That is, as the seal 124 wears, the bottom panel 32 can be forced further downwardly so that the plunger 121 moves further to the left (as viewed in FIG. 7). The spring 139 maintains a load on the seal 124 due to the cooperation between the locking pin 115 and the inclined surface 122 of the plunger 121 so that the seal 124 acts on the floor 18 of the truck trailer 10 with a force.

The rack 130 is driven to the left by rotating a spur gear 141, which has its teeth meshing with the teeth of the rack 130, counterclockwise (as viewed in FIG. 7). The gear 141 is mounted on a shaft 142 (see FIG. 9) and secured thereto by a pin 143, which passess through diametrically disposed portions of the hub of the gear 141 and the shaft 142.

The shaft 142 is rotatably supported in a bearing block 144, which is welded to a mounting plate 145. The mounting plate 145 and the mounting plate 132 are secured by carriage bolts 146 and nuts 147 to the skin 80 of the bottom panel 32. The skin 79 and the core 78 have aligned enlarged openings 148, and 148', respectively, for access to the nuts 147.

A handle 149 is secured to the end of the shaft 142 remote from the gear 141 to enable the gear 141 to be rotated through 180°. The handle 149 has an opening intermediate its ends. When the door 20 is in its unlocked condition as shown in FIG. 7, the opening in the handle 149 is aligned with an opening 151 (see FIG. 7) in an L-shaped locking bracket 152, which is welded in the mounting plate 145. A pad lock (not shown) retains the handle 149 in this position.

When the door 20 is locked, the handle 149 has its opening aligned with an opening 153 in an L-shaped locking bracket 154, which is welded to the mounting plate 145. When the opening in the handle 149 is aligned with the opening 153 in the bracket 154, a pad lock (not shown) can e extended through both of these openings to lock the door 20 in its locked position.

The spur gear 141 not only cooperates with the rack 130 but also with a rack 155, which is connected to a plunger (not shown) by a push rod 157 (see FIG. 9). The push rod 157 has a flat portion 156 welded to the rack 155. The plunger, which is like the plunger 121 and is resiliently connected to the push rod 157 in the same manner as the plunger 121 is resiliently connected to the push rod 134, cooperates with a locking pin (not shown), which is adjustably supported on the right hand mounting angle (not shown) in the same manner as the locking pin 115 is adjustably mounted on the left hand mounting angle 16, in the same manner as the plunger 121 cooperates with the locking pin 115. Thus, both sides of the bottom panel 32 of the door 20 are locked simultaneously by the counterclockwise (as viewed in FIG. 7) rotation of the gear 141 through 180°.

The rack 155 slides between guides 159 and 160 (see FIG. 9). The guides 159 and 160 are welded to the mounting plate 132.

Because of the foregoing arrangement, the locking mechanism can be easily adapted to various widths of the door 20. It is first necessary to remove the mounting plate 145 from its connection to the bottom panel 32. This enables the gear 141 to be removed from engagement with the teeth of the racks 130 and 155. Then, the racks 130 and 155 can be moved in accordance with the width of the door 20. When the racks 130 and 155 are properly adjusted, the gear 141 is disposed in engagement with the teeth of the racks 130 and 155 and the mounting plate 145 is secured to the bottom panel 32.

Considering the operation of the overhead door 20 of the present invention with the door 20 being assumed initially closed so that the upper panel 30 of the door 20 is engaging a seal 161, which is supported by the rear wall 15, the handle 149 must be unlocked from the locking bracket 154. Then, the handle is rotated clockwise (as viewed in FIG. 7) through 180° so that the opening in the handle 149 is aligned with the opening 151 in the bracket 152.

Then, the overhead door 20 can be raised to open the vertical opening 15 in the truck trailer 10. As the door 20 is lifted, the gears 62 (see FIG. 5), which are carried by the carriage 33, are rotated through cooperating with the racks 64 on the tracks (one shown at 22) to untighten the spring 68 and decrease the counterbalance force on the door 20.

When the door 20 is to be lowered, the bottom panel 32 is grasped and the door 20 is returned to the position in which the handle 149 can be rotated counterclockwise (as viewed in FIG. 7) so that the opening in the handle 149 again becomes aligned with the opening 153 in the locking bracket 154 to lock the door 20 to the truck trailer 10. During the lowering of the door 20, the gears 62 are rotated by the racks 64 to wind the spring 68 and increase the counterbalance force acting on the door 20.

While the present invention has been shown and described as being used with the truck trailer 10, it should be understood that it may be employed with any container having a vertical opening. For example, it may be employed with a railroad piggyback trailer or a sea container, for example.

An advantage of this invention is that it reduces the weight of the vehicle while using an overhead door. Another advantage of this invention is that the overhead door may be readily cut to any width. A further advantage of this invention is that it increases the storage space in a container in comparison with previously available overhead doors. Still another advantage of this invention is that it is safer than overhead doors using cables to connect the counterbalance mechanism thereto. A still further advantage of this invention is that there is no installation problem as there is with an overhead door using cables. Yet another advantage of this invention is that it reduced the installation cost.

For purposes of exemplifications, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A manually movable overhead door for closing an opening in a wall of a container including a plurality of panels, hinge means for connecting said panels to each other, track means supported by walls of the container on each side of the door, said panels being movably supported by said track means, said track means on each side of the door including a vertical portion, a horizontal portion, and a curved portion connecting said vertical portion and said horizontal portion to each other, each of said horizontal portions being disposed substantially inwardly in the container of the vertical portion of said track means, a carriage connected to the uppermost of said panels and movably supported only on said horizontal portions of said track means irrespective of the position of said panels, counterbalance means supported on said carriage to exert a counterbalance force to said panels in accordance with the position of said panels on said track means, and means to decrease the counterbalance force produced by said counterbalance means as said panels are raised toward the full open position of the door, said decreasing means including means supported on each side of the door and means cooperating with said supported means and acting on said counterbalance means to decrese the counterbalance force as said panels are raised toward the full open position of the door, said supported means including a rack supported on each side of the door, each of said racks terminating prior to the plane containing the door when the door is in its closed position, and said cooperating means including gear means connected to said counterbalance means and engaging the teeth of each of said racks, each of said racks being supported by said track means, each of said racks extending for only the length of said horizontal portion of said track means, said counterbalance means including a spring having one end fixed to said carriage and its other end connected to said gear means, said gear means being rotatably mounted on said carriage whereby rotation of said gear means unwinds said spring as said panels are raised toward the full open position of the door, means to lock the lower most of said panels when the door is in its closed position, said lock means including first means adjustably supported on each side of the door and second means carried by the lower most of said panels and cooperating with each of said first means, said second means of said lock means including a first pair of members movably supported by the lower most of said panels, a second pair of members connected to said first pair of members and movably supported by the lower most of said panels, means cooperating with said second pair of members to move each of said first pair of members into engagement with a corresponding one of said first means, and said cooperating means being removably supported by said lower most panel to enable said first and second pairs of members to be adjustably positioned in accordance with the width of said door.

2. The door according to claim 1 including:

flexible sealing means carried on the bottom of said lowermost panel to sealingly engage the floor of the container;

and resilient means connecting each of said first pair of members to the corresponding one of said second pair of members to compensate for wear of said sealing means.

3. A manually movable overhead door for closing an opening in a wall of a container including a plurality of panels, hinge means for connecting said panels to each other, track means supported by walls of the container of each side of the door, said panels being movably supported by said track means, said track means on each side of the door including a vertical portion, a horizontal portion, and a curved portion connecting said vertical portion and said horizontal portion to each other, each of said horizontal portions being disposed substantially inwardly in the container of the vertical portion of said track means, a carriage connected to the upper most of said panels and movably supported only on said horizontal portions of said track means irrespective of the position of said panels, counterbalance means supported on said carriage to exert a counterbalance force to said panels in accordance with the position of said panels on said track means, means to decrease the counterbalance force produced by said counterbalance means as said panels are raised toward the full open position of the door, means to lock the lower most of said panels when the door is in its closed position, said lock means including first means adjustably supported on each side of the door and second means carried by the lower most of said panels and cooperating with each of said first means, said second means of said lock means including a first pair of members movably supported by the lower most of said panels, a second pair of members connected to said first pair of members and movably supported by the lower most of said panels, means cooperating with said second pair of members to move each of said first pair of members into engagement with a corresponding one of said first means, and said cooperating means being removably supported by said lower most panels to enable said first and second pairs of members to be adjustably positioned in accordance with the width of said door.

4. The door according to claim 3 including:

flexible sealing means carried on the bottom of said lowermost panel to sealingly engage the floor of the container;

and resilient means connecting each of said first pair of members to the corresponding one of said second pair of members to compensate for wear of said sealing means.

5. A manually movable overhead door for closing an opening in a wall of a container including a plurality of panels, hinge means for connecting said panels to each other, track means supported by walls of the container on each side of the door, said panels being movably supported by said track means, said track means on each side of the door including a vertical portion, a horizontal portion, and a curved portion connecting said vertical portion and said horizontal portion to each other, each of said horizontal portions being disposed substantially inwardly in the container of the vertical portion of said track means, a carriage connected to the upper most of said panels and movably supported only on said horizontal portions of said track means irrespective of the position of said panels, counterbalance means supported on said carriage to exert a counterbalance force to said panels in accordance with the position of said panels on said track means, means to decrease the counterbalance force produced by said counterbalance means as said panels are raised toward the full open position of the door, linkage means connecting each side of said carriage to each side of the upper most of said panels to enable said panels to be disposed in a vertical position to close the opening while said carriage remains on said horizontal portions of said track means.

6. The door according to claim 5 in which each of said linkage means includes:

a first link having one end pivotally connected adjacent the uppermost end of said uppermost panel and its other end pivotally connected to the end of said carriage closest to said uppermost panel;

a second link having one end pivotally connected to said uppermost panel adjacent its lowermost end and its other end pivotally connected to said carriage inwardly of the pivotal connection of said first link to said carriage;

the pivotal connection of said second link to said carriage being above the pivotal connection of said first link to said carriage;

and each of said pivotal connections of said links to said carriage remaining in the same horizontal planes irrespective of the position of said panels.

* * * * *